United States Patent [19]

Lavelle

[11] Patent Number: 4,887,442

[45] Date of Patent: Dec. 19, 1989

[54] ELECTRONIC LOCKSET ASSEMBLY AND CONTROL

[75] Inventor: Gary E. Lavelle, Avon, Conn.

[73] Assignee: Emhart Industries, Inc., Towson, Md.

[21] Appl. No.: 250,299

[22] Filed: Sep. 27, 1988

[51] Int. Cl.[4] ..... E05B 55/00

[52] U.S. Cl. ..... 70/143; 70/272

[58] Field of Search ..... 70/277, 278, 143, 279–283; 292/144

[56] References Cited

U.S. PATENT DOCUMENTS

| | | | |
|---|---|---|---|
| 4,333,324 | 6/1982 | Dietrich | 70/107 |
| 4,438,962 | 3/1984 | Soloviff | 292/144 |
| 4,594,864 | 6/1986 | Hart | 70/143 |
| 4,679,416 | 7/1987 | Kambia | 70/143 |

*Primary Examiner*—Robert L. Wolfe

*Attorney, Agent, or Firm*—Barry E. Deutsch; Carl A. Forest

[57] ABSTRACT

An electronic lock includes a bolt having a fully extended position when a door is closed and a partially extended position when the door is open. The lockset is selectively placed in a locked state when the bolt is in its fully extended position. A switch is responsive to the position of the bolt and has a first operating position when the bolt is fully extended and a second operating position when the bolt is partially extended. A processor is responsive to the switch for preventing the selective locking of the bolt when the bolt is partially extended.

9 Claims, 7 Drawing Sheets

FIG. 2
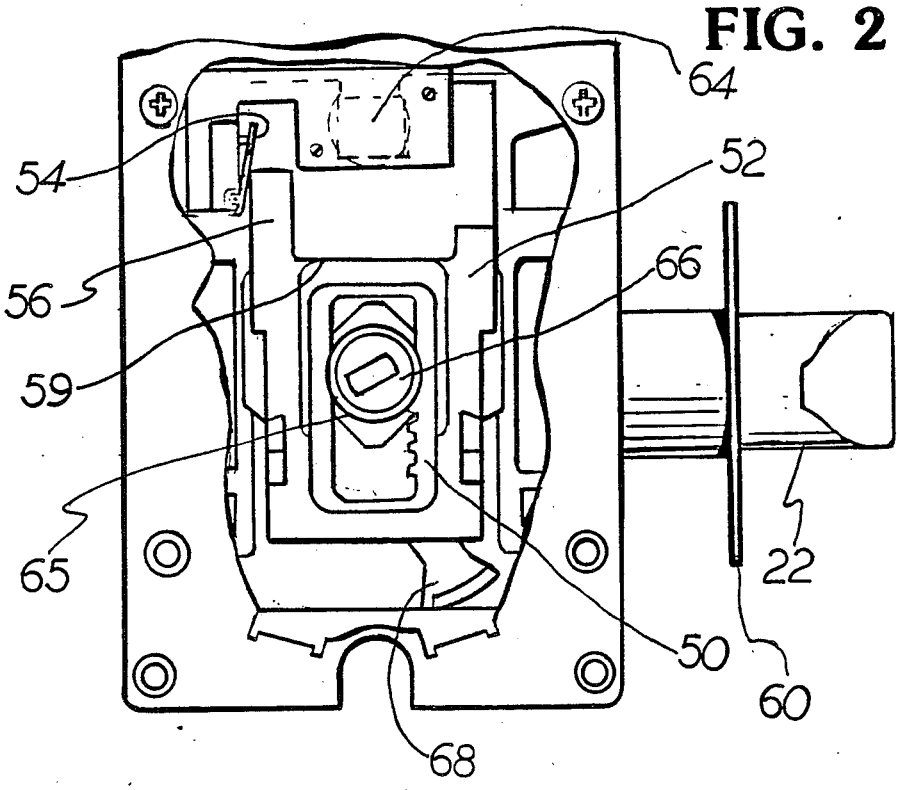
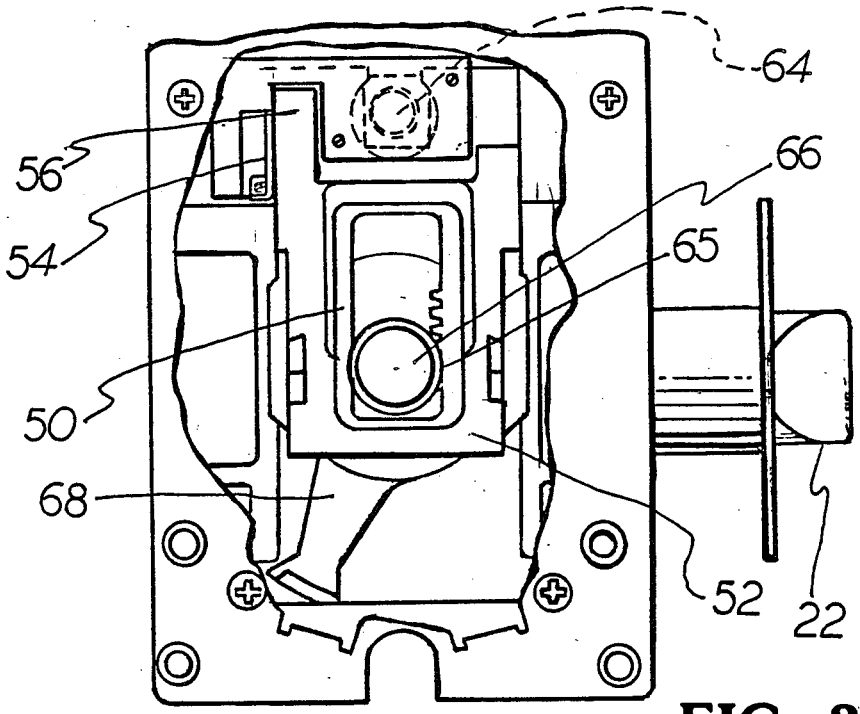
FIG. 3

FIG. 4
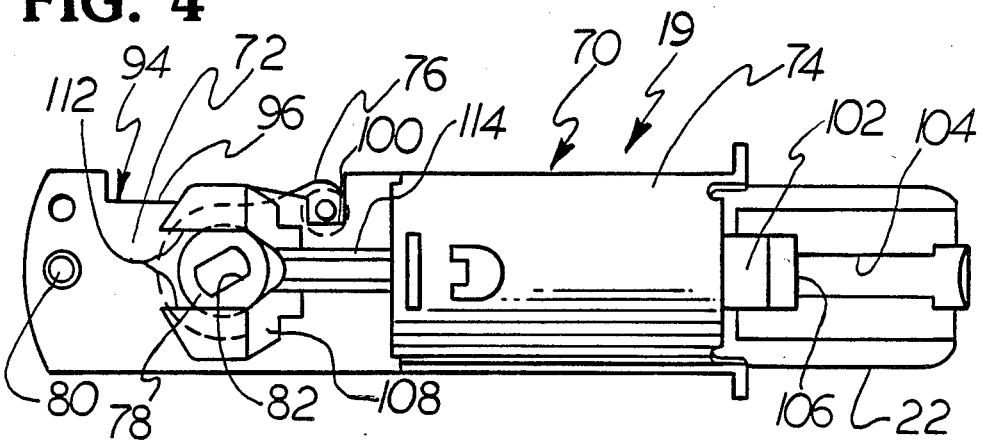
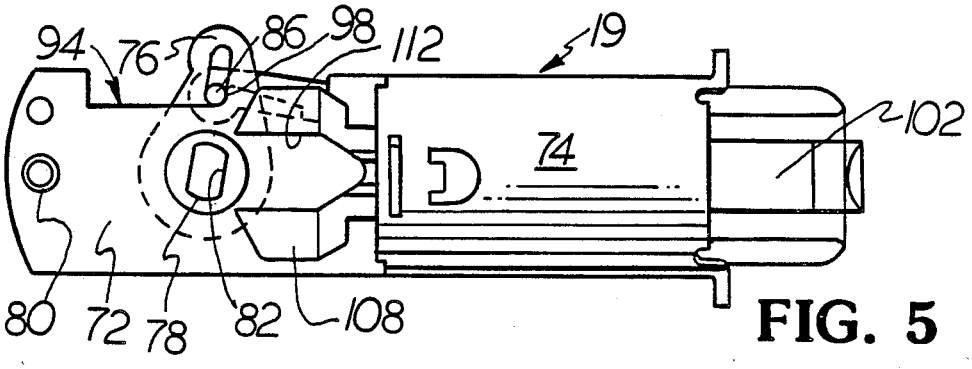
FIG. 5
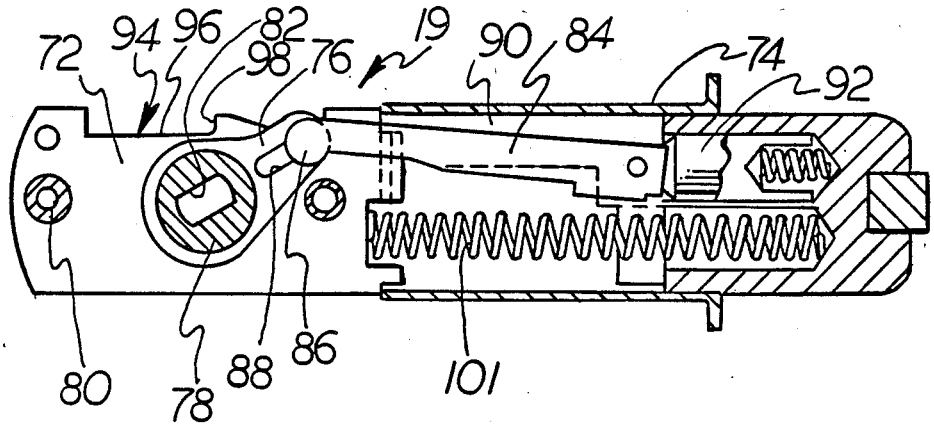
FIG.6

ELECTRONIC LOCKSET ASSEMBLY AND CONTROL

BACKGROUND OF THE INVENTION

This invention relates to electronic locksets and in particular to a control therefor which prevents the bolt of the lockset from being locked when the door is open.

Electronic locksets have gained increasingly widespread acceptance and use during the recent past. Such locksets are used in varied functions. For example, locksets are used in controlling egress and ingress through doors in hotels, office buildings, dormitories, classrooms, and the like. Although there are many similarities in the characteristics of the locksets used in the different functions, there are also significant differences.

For example, in a hotel function, it is desired for purposes of security that the outside hand operator remain in a locked or rigid state substantially at all times when the door is closed. The door may be opened from the outside solely by insertion into the lockset of a keycard (or the like) having a proper combination or code which actuates the locking mechanism of the lockset to permit the outside hand operator to be used for a rather limited time to retract the bolt.

The aforedescribed hotel lockset characteristic is not desirable for locksets providing a dormitory function. In the latter instance, the lockset should be capable of being placed in either an unlocked or locked state when the door is closed. In the unlocked state, the outside hand operator can be used to directly retract the bolt. The insertion of a properly coded keycard into the lockset to enable the door to be opened from the outside is not required when the lockset is in an unlocked state.

However, the dormitory function has its own rather unique requirement. To prevent the occupant of the room from being inadvertently or deliberately locked out, the bolt should be incapable of being electronically placed in a locked state when the door is open. Accordingly, it is an object of this invention to provide an electronic lock which can be utilized in applications requiring a dormitory function. It is a further object of the invention to unlock the bolt when the bolt has been retracted upon opening the door and to thereafter prevent the bolt from being locked while the bolt is in its retracted position.

SUMMARY OF THE INVENTION

These and other objects of the invention are attained in an electronic lockset assembly comprising a bolt having a fully extended position when a door is closed and a partially extended position when the door is open; means for selectively locking the bolt when in its fully extended position; switch means responsive to the position of the bolt and having a first position when the bolt is fully extended and a second position when the bolt is partially extended; and processing means responsive to the switch means for preventing the selective locking means from locking the bolt when the bolt is partially extended.

BRIEF DESCRIPTION OF THE DRAWING

FIG. 2 is an elevation view, partially broken away, showing details of the electronic lockset;

FIG. 3 is a view similar to that illustrated in FIG. 2 illustrating the bolt in a partially extended position;

FIG. 4 is an elevation view of the latch bolt assembly, with the bolt in a fully extended position;

FIG. 5 is a view similar to that illustrated in FIG. 4 showing the latch bolt assembly, with the bolt in a partially extended position;

FIG. 6 is a sectional view of the latch bolt assembly illustrated in FIGS. 4 and 5;

DESCRIPTION OF THE PREFERRED EMBODIMENT

Figure 1:
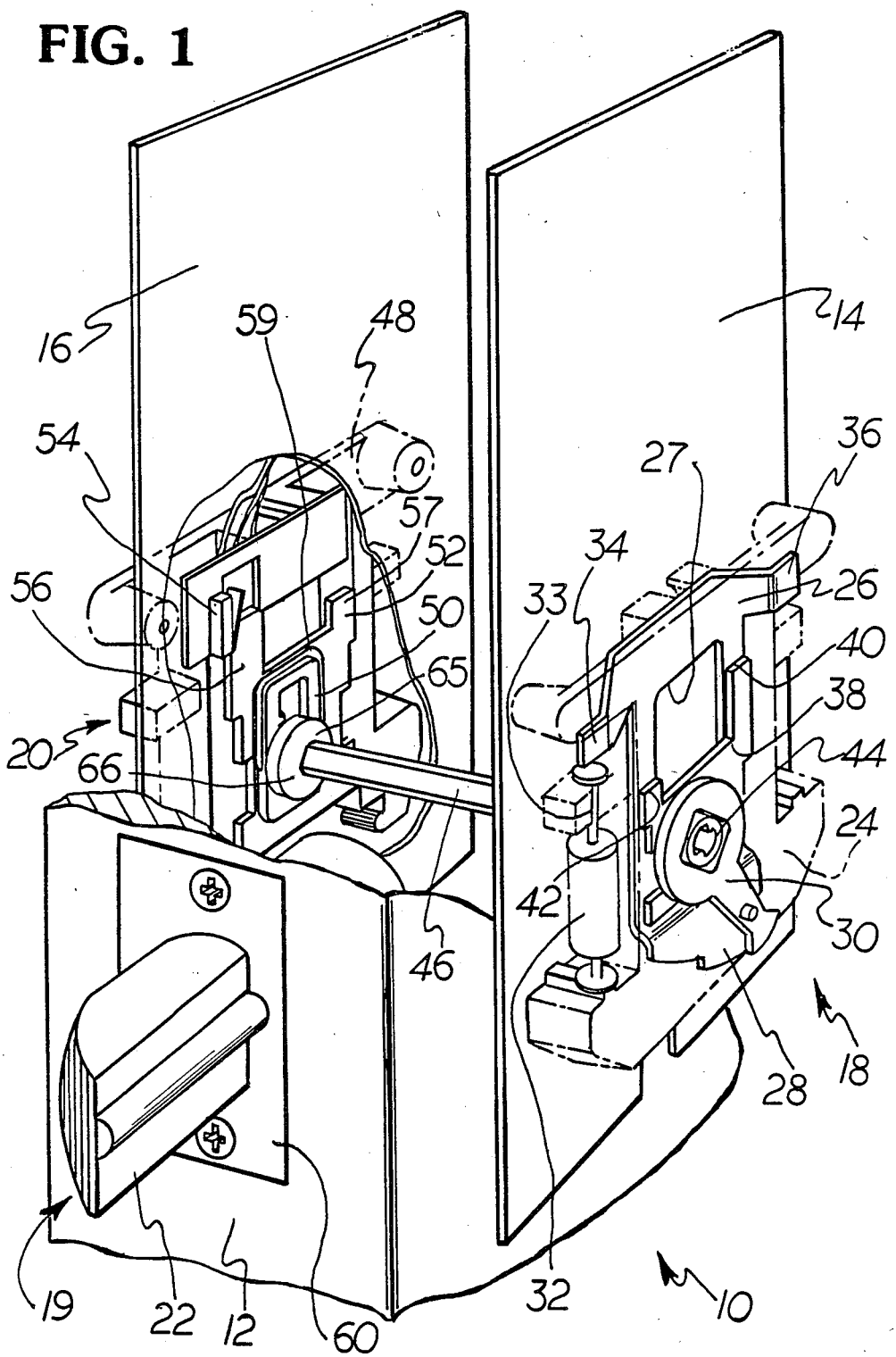
FIG. 1 is a perspective view of an electronic lockset in accordance with the present invention mounted on a door as viewed from the outside of the door towards its center, with the door partially broken away and certain parts of the lockset illustrated in phantom for the purpose of clarity.

Referring now to the various figures of the drawing, there is disclosed a preferred embodiment of the invention. In referring to the various figures of the drawing, like numerals shall refer to like parts.

Referring specifically to FIGS. 1–6 and 10, details of an electronic lockset embodying the invention are disclosed. Specifically, electronic lockset 10 is illustrated as mounted in door 12. The portion of the lockset mounted on the exterior face of the door is generally referenced by numeral 18 and likewise, the portion of the lockset mounted on the interior face of the door is generally referenced by numeral 20. The lockset is of the type which includes a card reader 200 (see FIG. 10) mounted on the exterior face of door 12. The card reader accepts a magnetically coded card (key) and reads the code. Other methods of encoding the card, e.g., optically, may also be used. If the code matches a code stored in the electronic memory of the lock, electric power will be utilized to cause the lockset to perform a desired operation.

Figure 10:
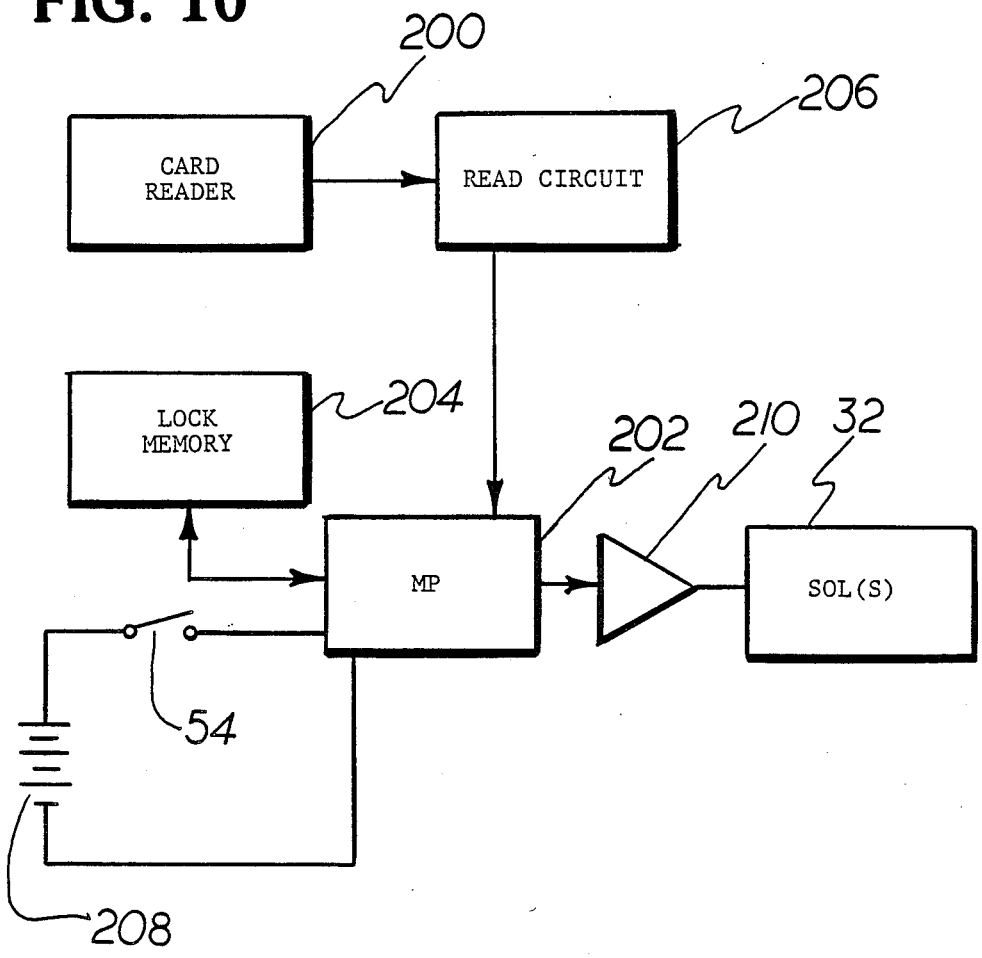
FIG. 10 is a block diagram schematically illustrating a control circuit in accordance with the invention.

As illustrated in FIG. 10, electronic lockset 10 includes microprocessor 202, lock memory 204, and read circuit 206 in addition to reader 200. Memory 204 may include an electrically erasable programmable read-only memory portion (EEPROM) which supplies an operating program for microprocessor 202 and also stores lock access combinations and a random access memory portion (RAM) which stores lock combinations obtained from the electronically coded card. Card reader 200 reads the data on the card and supplies corresponding signals to read circuit 206 which converts the output from card reader 200 to digital format for transmission to microprocessor 202. One or more batteries 208 serve as a power source for lockset 10. By way of example, battery means 208 may comprise three lithium batteries connected in series nominally three volts per battery. A buffer or driver 210 is connected to microprocessor 202 for driving one or more solenoids 32 of the lockset. The function of solenoids 32 shall be more fully described hereinafter.

Exterior portion 18 includes cover plate 14 mounted on the exterior face of door 12. Exterior portion 18 further includes support member 24 shown in phantom. Mounted on support member 24 are a pair of solenoids 32 (only one of which is shown) and an auxiliary solenoid (not shown) having its axis disposed generally normal to the axes of solenoids 32. Exterior portion 18 further includes vertically moveable locking member 26 which includes nose piece 28, rotatable actuating member 30, cam plate 38, and pinion 44 extending through a central opening of actuator 30. Locking member 26 includes ears 34, 36 positioned vertically above solenoids 32. When rod 33 of each solenoid is extended vertically upwardly, the rods engage ears 34, 36 to move the locking member upwardly relative to a portion of actuator 30 which lies in the same vertical plane as nose piece 28. Until such time as the solenoids move locking member 26 vertically upward, the locking member prevents rotation of actuator 30. Cam plate 38 includes upwardly extending arms 40, 42.

Exterior portion 18 further includes a rack plate (not shown) which is similar in appearance to rack plate 50 of interior portion 20. Gear teeth on the head of pinion 44 engage corresponding teeth located in a vertically extending slot formed in the rack plate. As a consequence, rotation of pinion 44 results in vertical movement of the rack plate. The rack plate is positioned within vertically extending slot 27 of locking plate 26 whereby the height of the slot is substantially larger than the vertical height of the plate, thereby enabling the rack plate to move freely relative to the locking plate.

Spindle 46 extends longitudinally between outside portion 18 and inside portion 20 in a manner well known to the art. Rotation of spindle 46 results in movement of bolt 22 of latch bolt assembly 19. The details of latch bolt assembly 19 will be described hereinafter.

Spindle 46 extends between head 66 of inside pinion 65 and the head (not shown) of outside pinion 44. Interior portion 20 includes, in addition to pinion 65, vertically moveable rack plate 50 which extends within vertically extending slot 59 formed within cam plate 52. Cam plate 52 includes vertically extending arms 56, 57, with the vertical height of arm 56 being substantially greater than the vertical height of arm 57. Normally open switch 54 is mounted on support member 48. Switch 54 is positioned within the vertical plane of movement of arm 56 of cam plate 52. For a more detailed explanation of the construction and operation of inside and outside operating portions 20 and 18, reference may be made to co-pending U.S. patent application Ser. No. 099,937 filed Sept. 23, 1987, in the name of George Frolov and assigned to the same assignee as the assignee of this application.

As illustrated in FIGS. 2 and 3, inside portion 20 also includes rotatable actuator 68. FIG. 2 illustrates the position of the actuator when bolt 22 is fully extended, whereas FIG. 3 illustrates the position of the actuator when bolt 22 is partially retracted. It should be noted that, in FIG. 2 with the bolt fully extended, the position of arm 56 relative to switch 54 is such that the switch is in its normally open position. This should be contrasted to FIG. 3 which illustrates the bolt in its partially retracted position. Vertical movement of cam plate 52 is caused primarily by rotation of actuator 68. Actuator 68 is rotated in response to movement of a hand operator (not shown) such as a lever. The hand operator is moved to retract latch bolt 22 as is well known in the art. Vertical movement of cam plate 52 results in simultaneous vertical movement of rack plate 50. Such movement provides concomitant rotation of pinion 65 and spindle 46. The vertical movement of cam plate 52 also results in closure of switch 54 as illustrated in FIG. 3. The importance of the relationship between the positions of switch 54 and bolt 22 shall be more fully described hereinafter.

Referring now to FIGS. 4–6, details of latch bolt assembly 19 shall now be more fully described. Latch bolt assembly 19 includes latch case 74 having two spaced latch plates 72 (only one of which is shown) extending rearwardly therefrom. Latch plates 72 are held together by means of bushings 80. Hub member 78 upon which two lever plates 76 (only one of which is shown) are mounted for rotation therewith is provided between the two latch plates 72. Hub member 78 has a generally rectangular bore 82 shaped to receive spindle 46. Bolt 22 is mounted within latch case 74 and has an arm 84 (FIG. 6) extending rearwardly therefrom toward lever plates 76. Arm 84 is pivotally attached at its forward end to bolt 22 and at its rearward end has a pivot pin 86 extending through an elongated slot 88 in each of the lever plates 76. Arm 84 is positioned within a guide 90 which has opposed side walls. Guide 90 is also pivotally attached to the rearward end of bolt 22.

Spring biased dowel 92 is mounted in bolt 22 and has its end face engaging one corner on the forward portion of arm 84. This serves to bias arm 84 in a direction such that pivot pin 86 will engage upper edges 94 of latch plates 72. The upper edges of latch plates 72 include a rearward cut-out portion 96 forming rearward facing stop shoulders 98 engagable by pin 86 to stop latch bolt 22 in its partially retracted position illustrated in FIG. 5. Forward of cut-out portion 96, the upper edges slope downwardly toward another cut-out portion forming a notch 100 to releasably retain bolt 22 in the extended position illustrated in FIG. 4. Spring 101 extends between plates 72 and bolt 22 to bias the bolt towards its forward position.

Latch release plunger 102 is mounted in a slot 104 in bolt 22 and has a forwardly extending strike abutting portion 106 extending forwardly from the latch case 74 and cam portion 108 extending rearward from latch case 74. Cam portion 108 of plunger 102 is forked and includes upper and lower rearward facing cam surfaces 112. Intermediate portion 114 of latch release plunger 102 is channel shaped in which a spring (not shown) is mounted to bias plunger 102 into its forward position. As illustrated in co-pending U.S. patent application Ser. No. 799,555, filed Nov. 19, 1985, in the name of LeRoy Hart, and assigned to the same assignee as the assignee hereof, inward movement of the bolt results in inward movement of plunger 102 through engagement of opposed shoulders on the bolt and plunger respectively. The subject co-pending application should also be referred to for a more detailed description of the latch bolt assembly.

To describe the basic operation of electronic lockset 10 heretofore described, let us initially assume that door 12 is closed and the room is occupied. Let us also assume that the room is located in a dormitory. If the occupant of the room desires to leave same, the occupant manipulates the hand operator, for example, a lever, of the inside portion of lockset 10 to retract latch bolt 22, to open the door and leave the room.

When the door is closed, the latch bolt is in the position illustrated in FIG. 2. When the occupant of the room manipulates the hand operator of the inside portion 20, actuator 68 is rotated to vertically raise cam plate 52 which, through its physical engagement with rack plate 50, results in vertical movement of the rack plate. Through engagement of the gear teeth 61 of rack plate 60 with corresponding gear teeth on pinion 65, the vertical movement of the rack plate results in rotation of pinion 65 and simultaneous rotation of spindle 46. Rotation of spindle 46 results in retraction of latch bolt 22. The latch bolt is fully retracted to enable the occupant of the room to open the door and pass through the door opening. When the actuator is released, latch bolt 22 is moved to the partially extended position illustrated in FIG. 3.

As more fully described in co-pending application Ser. No. 799,555, plunger 102 of the latch bolt assembly functions to automatically return latch bolt 22 to its fully extended position (as illustrated in FIG. 2) when the door is reclosed. In some applications such as hotels and motels, the lockset should be automatically returned to a locked state when the door is reclosed and latch bolt 22 returns to its fully extended position. In other applications, it is desirable that the latch bolt is returned to its fully extended position when the door is closed, but that the lockset is placed in an unlocked state. Applications of the latter type would, for example, include a dormitory function.

In a dormitory or similar function, it is desirable that at certain times the lockset is retained in an open, latched state when the door is closed. At other times when the room is occupied, the occupant may desire to place the lockset in a locked state. Accordingly, pushbutton switch 64 is provided on inside portion 20 of the lockset to enable the occupant of the room to place the lockset in a locked state when the room is occupied. It is also desirable to prevent the occupant of the room from inadvertently locking himself out of the room when the occupant has left the room and closed the door, but left the lockset in an unlocked state.

Figure 7:
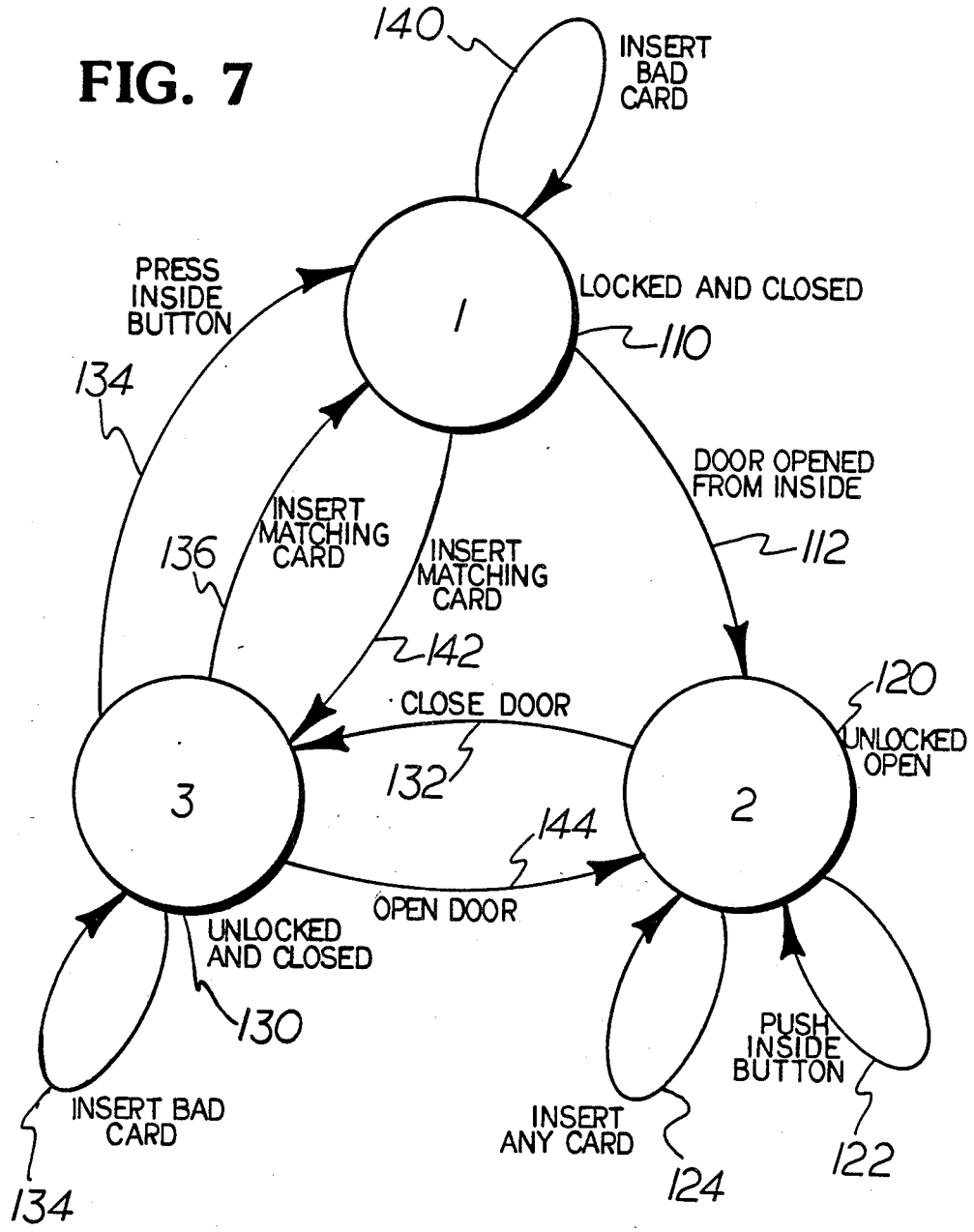
FIG. 7 is a state diagram illustrating the dormitory function.

FIG. 7 illustrates the various states of the lockset which are required to satisfy all conditions associated with a dormitory function. Reference numeral 110 represents the state of the lockset when the door is closed and the lock is locked. In this state, let us first assume that the room is occupied. When the occupant of the room desires to exit therefrom, he opens the door (step 112) and places the lockset in an open state represented by reference numeral 120. Bolt 22 is moved from its fully extended position (FIG. 2) to its fully retracted position to enable the occupant to open the door, and thence when the occupant releases the actuator, the bolt moves to its partially extended position (FIG. 3). When the door has been opened, the lockset cannot be returned to a locked state until certain conditions have been satisfied. For example, if, while the door is open, someone were to attempt to lock the lock by closing pushbutton switch 64 as represented by reference numeral 122, the closure of the pushbutton switch would have no affect on the lock and the lockset would remain open. Similarly, if one were to insert either a properly encoded or an improperly encoded card into the card reader of the exterior portion 18 of the lockset as represented by arrowed line 124, the lockset would remain in an open state. Thus, as long as the door is open, the lockset cannot be returned to a locked state.

Assume now door 12 is closed as represented by reference numeral 132. When the door is closed, plunger 102 operates to return bolt 22 to its fully extended position from its partially extended door open position. When the door is initially closed, the lockset is in an unlocked state as represented by numeral 130. If the door has been reclosed by the occupant after he re-enters the room, he can press pushbutton switch 64 to relock the lock as represented by arrowed line 134. Further, someone who is located on the outside of door 12 can insert a properly encoded card into the card reader of exterior portion 18 and return the lock to a locked state as represented by arrowed line 136. The insertion of a bad or improperly encoded card into the card reader will not have any effect on the state of the lock, and it will remain in its present state as represented by arrowed lines 138 and 140. If the lockset is locked and the door is closed, the insertion of a properly encoded card into the card reader will cause the lockset to move to an unlocked state as represented by arrowed line 142. Finally, as represented by arrowed line 144, door 12 may be opened when the door is closed and lockset 14 is in an unlocked state.

Switch 54 in association with cam plate 52 provides the necessary sensing means to attain the various states and modes of operation illustrated in FIG. 7. In particular as noted previously, switch 54 is a normally open switch and is in its normally open position when bolt 22 is in its fully extended position as illustrated in FIG. 2. When the bolt is retracted to open the door, cam plate 52 is moved upwardly so that arm 56 thereof closes switch 54. Switch 54 will remain closed so long as bolt 22 is fully retracted or in its partially extended position. Bolt 22 remains in its partially extended position until plunger 102 functions to extend the bolt upon reclosure of the door.

Figure 8:
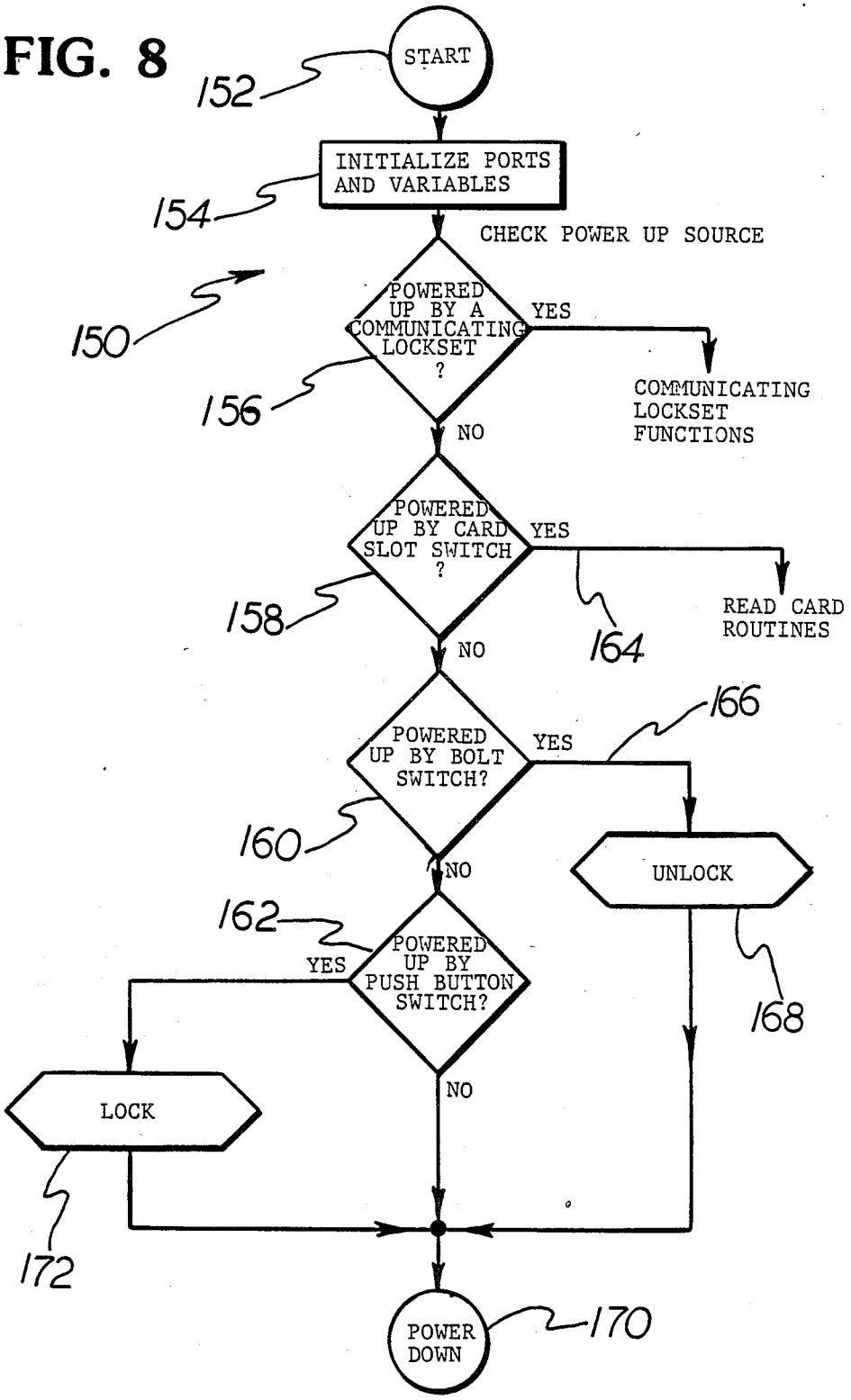
FIG. 8 is a flow chart illustrating the process by which the dormitory function is attained in accordance with the present invention.

FIG. 8 is a flow chart illustrating a computer program 150 utilized to control the operation of lockset 14 to attain the dormitory function. At step 152, the lockset which is assumedly in a quiescent state, has electrical power supplied thereto by the occurrence of an event. Electrical power is supplied from battery 208. At step 154, certain events automatically occur upon the supply of electrical power to the lockset. At steps 156, 158, 60, and 162, a predetermined sequence is established for the specific event which has triggered the supply of electrical power to the lockset. Specifically, at step 156 a check is made to determine if electrical power has been supplied to lockset 14 through a communicating lockset. Communicating locksets are found in hallway or communicating doors in hotel rooms. Communicating locksets are never found in a dormitory function. Thus, the check performed at step 156 will always be answered by "NO".

The "NO" response results in the program advancing to next step 158 which checks to see if the lockset 14 has been powered up by the insertion of a card into card reader 200 of exterior portion 18 of the lockset. If the answer is "YES", the program moves along line 164 and functions in a normal manner to unlock the lockset if codes on the key match codes in the lock.

However, in the event checking at step 158 results in a "NO" answer, the program institutes a third check at step 160 to determine if lockset 14 has been powered up through closure of switch 54. As discussed previously, switch 54 is closed when bolt 22 is retracted to open the door. In the event checking at step 160 results in a "YES" answer, the program moves along line 166 to place the lockset in an unlocked state at step 168 and thereafter remove power from the lockset at step 170 to retain the lockset in said unlocked state.

In the event checking at step 160 results in a "NO" response, the program automatically advances to the next step 162 to determine if power has been supplied to the lockset by closure of pushbutton switch 64. If the response is "YES", the lock is placed in a locked state at step 172 and the supply of power to the lockset is discontinued at step 170.

It should be noted that in the event someone were to attempt to lock lockset 14 through closure of switch 64 while bolt 22 is in its partially extended position, the lockset could not be so locked. Since checking steps 156 through 162 occur sequentially as long as the bolt is in its partially extended position and cam plate 52 closes normally open switch 54, checking step 160 will always result in a "YES" answer which will immediately place the lock in an unlocked state. The program will never advance to step 162.

Figure 9:
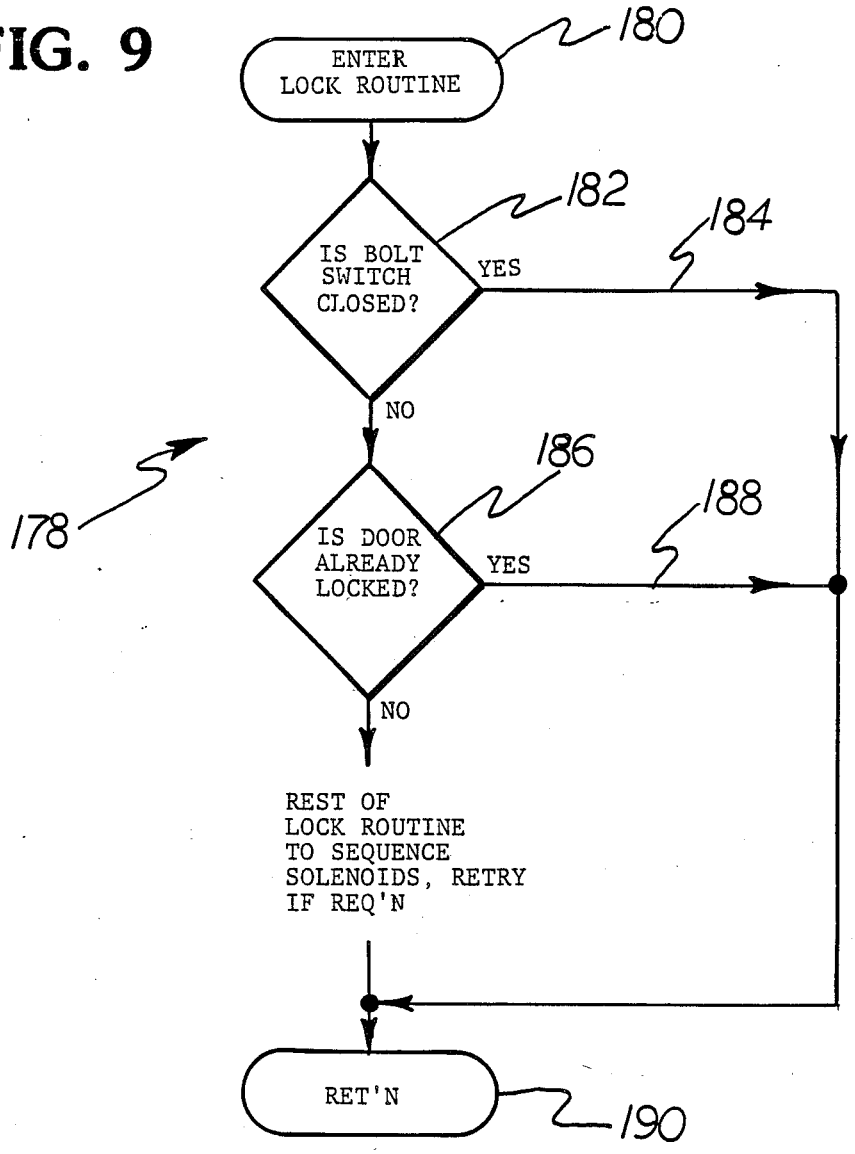
FIG. 9 is a flow chart illustrating a subroutine of the flow chart illustrated in FIG. 8, through which subroutine the outside lever of the electronic lockset is placed in a locked state.

With reference to FIG. 9, a second flow chart is illustrated which provides a subroutine program 178 which is activated when someone attempts to lock exterior portion 18. When a properly encoded card is inserted, or pushbutton switch 64 is closed, as at step 180, the program advances to step 182 to check to determine if bolt switch 54 is closed. If the answer is "YES", the program advances along line 184 to discontinue the supply of electrical power to the lockset and retain the lockset in an open state.

However, if the check performed at step 182 results in a "NO" response, the program advances to step 186 to determine if the lockset is already locked. If the check performed at step 186 results in a "YES" response, the program advances along line 188 to discontinue the supply of electrical power to the lockset and retain the lockset in a locked state.

However, in the event the check performed at step 186 results in a "NO" response, electrical power is supplied to the lockset so that the lockset is placed in a locked state and thereafter the program returns to the step of main program 150 which generated implementation of subroutine 178.

The instant invention senses the position of latch bolt 22 and, through the use of an associated computer program, provides a dormitory function for an electronic lockset. Latch bolt 22 and switch 54 provide an electrical control signal to processor 202 in which programs 150 and 178 are stored with the magnitude of the control signal being indicative of the position of the bolt.

While a preferred embodiment of the present invention has been described and illustrated, the invention should not be limited thereto, but may be otherwise embodied within the scope of the following claims.

I claim:

1. A control for an electronic lockset of the type having a bolt movable between a bolt fully extended position when a door is closed and a bolt partially extended position when the door is open, said control comprising:

actuator means for moving the bolt between its fully extended and partially extended positions;

switch means responsive to the position of the bolt and having a first position when the bolt is fully extended and a second position when the bolt is partially extended;

means for selectively locking the bolt when the bolt is in its fully extended position; and processing means responsive to the switch means for preventing the selective locking means from locking said lockset when said bolt is in its partially extended position.

2. A control for an electronic lockset in accordance with claim 1 wherein the selective locking means includes a pushbutton switch mounted on the inside of the door and operable to lock the bolt when the bolt is in its fully extended position.

3. A control for an electronic lockset in accordance with claim 2 wherein said processing means prevents locking of the bolt by said pushbutton witch when said switch means is in its bolt partially extended position.

4. An electronic lockset assembly comprising:

a bolt having a fully extended position when a door is closed and a partially extended position when the door is open;

means connected to said bolt for moving said bolt between said positions including a support member, a pivotable actuating member supported on said support member, a cam plate movably responsive to pivotable movement of said actuating member, a rack plate connected to said cam plate for movement therewith and a pinion rotatable in response to movement of said rack plate;

means for selectively locking the bolt when the bolt is in its fully extended position;

switch means mounted on said support member and having a first operating state when the bolt is fully extended and a second operating state when the bolt is partially extended, said cam plate being in spaced relation relative to said switch means when the bolt is in a selected one of its positions and being moved into engagement with said switch means when the bolt is in the other of its said positions for moving the switch means from one to the other of its operating states; and processing means responsive to the operating state of the switch means for preventing the selective locking means from locking the bolt when the bolt is partially extended.

5. An electronic lockset assembly in accordance with claim 4 wherein the selective locking means includes a pushbutton switch mounted on the inside of the door and operable to lock the bolt in its fully extended position.

6. An electronic lockset assembly in accordance with claim 5 wherein said processing means prevents locking of the bolt by said pushbutton switch when said switch means is in its bolt partially extended position.

7. An electronic lockset of the type having a bolt movable between a bolt fully extended position when a door is closed and a relatively retracted position when a door is open, said lockset comprising:

switch means responsive to the position of the bolt and having a first operating state when the bolt is fully extended and a second operating state when the bolt is relatively retracted;

means for selectively locking the bolt in its fully extended position; and processing means responsive to said switch means for unlocking the bolt when the bolt has been moved from its fully extended to its relatively retracted position and thereafter preventing the selective locking means from locking the bolt as long as the bolt is in its relatively retracted position.

8. An electronic lockset in accordance with claim 7 wherein the selective locking means includes a pushbutton switch mounted on the inside of the door and operable to lock the bolt in its fully extended position.

9. An electronic lockset in accordance with claim 8 wherein said processing means prevents locking of the bolt by said pushbutton switch when said switch means is in its second operating state.

* * * * *